US005275403A

United States Patent [19]

Jones

[11] Patent Number: 5,275,403

[45] Date of Patent: Jan. 4, 1994

[54] GOLF CLUB WITH TARGET VIEWING REFLECTOR IN SHAFT

[76] Inventor: Thomas L. Jones, 11 Yorkshire St., Asheville, N.C. 28803

[21] Appl. No.: 896,594

[22] Filed: Jun. 10, 1992

[51] Int. Cl.[5] ..... A63B 69/36; A63B 53/02; A63B 53/14

[52] U.S. Cl. ..... 273/164.1; 273/35 A; 273/80.1; 273/81.4; 273/81 B

[58] Field of Search ..... 273/80.1, 194R, 77R, 163A, 164.1, 81.4, 81B, 35A, 186.2, 187.4, 163R, 164.2

[56] References Cited

U.S. PATENT DOCUMENTS

| | | | |
|---|---|---|---|
| 2,325,525 | 7/1943 | Lukenbill | 273/80.1 X |
| 2,463,200 | 1/1949 | Pitzer | 273/194 |
| 2,822,614 | 2/1958 | Susinno | 273/163 R |
| 2,898,109 | 8/1959 | Williams | 273/163 R |
| 3,035,839 | 5/1962 | Coglianese | 273/164 |
| 3,118,678 | 1/1964 | Rohr | 273/163 R |
| 3,143,349 | 8/1964 | MacIntyre | 273/171 |
| 3,170,698 | 2/1965 | Schoeffler | 273/163 R |
| 3,273,891 | 9/1966 | Grim, Jr. | 273/163 R |
| 3,421,765 | 1/1969 | Scott | 273/163 R |
| 3,448,981 | 6/1969 | Anweiler | 273/80 |
| 3,810,633 | 5/1974 | Scott, III | 273/183 D |
| 3,953,034 | 4/1976 | Nelson | 273/194 R |
| 3,966,210 | 6/1976 | Rozmus | 273/169 |
| 4,053,160 | 10/1977 | Salata | 273/186 A |
| 4,116,448 | 9/1978 | Crowe, Jr. | 273/186 A |
| 4,147,357 | 4/1979 | Strop | 273/164 |
| 4,211,416 | 7/1980 | Swanson | 273/164 |
| 4,537,403 | 8/1985 | Farina | 273/164 |
| 4,884,813 | 12/1989 | Cates | 273/183 D |
| 4,953,866 | 9/1990 | Bang | 273/183 D |
| 5,052,114 | 10/1991 | Levenson | 33/286 |
| 5,169,152 | 12/1992 | Marquardt | 273/77 R X |

*Primary Examiner*—George J. Marlo
*Attorney, Agent, or Firm*—Pollock, Vande Sande & Priddy

[57] ABSTRACT

A golf club comprising a hollow shaft having a top end in the vicinity of which a golfer grips the golf club, a bottom end within the vicinity of which a club head is attached, and an opening in the vicinity of the top end of the hollow shaft. The opening allows the golfer to look into the hollow shaft. A reflecting assembly located within the hollow shaft includes a reflective surface for reflecting through the hollow shaft an image of a target area where a golfer desires to hit a golf ball, thereby allowing the golfer to view simultaneously the target area while looking at the golf club. The shaft includes a first passage formed substantially opposite the reflecting surface. The first passage permits the image to impact on the reflecting surface and be reflected through the hollow shaft toward the top end of the shaft.

23 Claims, 3 Drawing Sheets

GOLF CLUB WITH TARGET VIEWING REFLECTOR IN SHAFT

FIELD OF THE INVENTION

The present invention relates to a golf club including a reflecting assembly internal to the shaft of the club, accuracy enhancing improvements to the club head, and/or an improved grip. In a preferred embodiment, the present invention relates particularly to a putter including a head incorporating accuracy enhancing improvements.

BACKGROUND OF THE INVENTION

Golf is an old sport, having originated in Scotland and then introduced to America some time later. Although the overall design of golf clubs has remained some what similar throughout the history of golf, some modifications have occurred. Such modifications have included, among others, designs formed on the faces of the club head to influence the trajectory of the ball upon impact with the club head face and altered shapes of club heads. Many of the modifications to golf clubs have come in the area of the materials used to construct the clubs. In an effort to make golf clubs lighter and/or more durable, materials such as carbon fiber and light weight metallic alloys have been used to construct various parts of golf clubs. For instance, many "woods" sold today are made of metal.

In spite of the modifications to golf clubs which enhance performance, golf remains a difficult game to learn and play with skill. Minor variations in a golf swing or club position in any type of golf shot can result in the golf ball missing its target by a wide margin. Such problems include, among other things, the rotation or angling of the head of the golf club upon impact with the golf ball in the event that the ball is not struck exactly on the optimal spot on the club head. Additionally, problems also arise when the golfer attempts to look up to see the target of a golf shot and then down to align the club face, often resulting in the movement of the club as the golfer moves his or her body. In an effort to address problems involved in aiming and swinging a golf club, certain modifications were made to the basic club and/or shaft design.

For instance, it has been suggested to attach mirrors to the shaft or the head of golf clubs as exemplified by U.S. Pat. No. 4,053,160 to Salata and U.S. Pat. No. 4,953,866 to Bang. Additionally, modifications to the heads of golf clubs to achieve various effects have been suggested. Such modifications include, among others, U.S. Pat. No. 3,966,210 to Rozmus, which suggests a club head including concentrated masses of weight at certain points in the club head.

SUMMARY OF THE INVENTION

The present invention according to one embodiment solves problems existing in prior art golf clubs by providing a golf club incorporating a reflecting means into the shaft of the club.

More particularly, one aspect of the present invention provides a golf club having a hollow shaft including at least one reflecting means placed within the shaft and a golf club head being attached near or within the vicinity of the bottom end of the shaft.

According to another aspect of the present invention a golf club including arms of equal length attached to the periphery of the golf club head and connected to the shaft to resist the rotational force on the club head when striking a golf ball is provided.

A still further aspect of the present invention is a golf club including an oversized tennis racket-like grip to resist the rotation of the golf club when striking a golf ball.

According to additional aspects of the present invention, a golf club including a head with an arcuate bottom surface from side to side as well as from front to back to help prevent the scraping of the golf club head on the ground when striking a golf ball is provided.

Furthermore, the present invention is concerned with a golf club head that includes a point of attachment which can be rotationally adjusted to accommodate golfers of various heights.

Although preferred aspects of the present invention include all modifications to a golf club discussed below, the invention contemplates using one, all, or any combination of the modifications.

The above and other aspects of the present invention are achieved by the structure as described below in combination with the accompanying drawings showing preferred embodiments of the present invention.

DETAILED DESCRIPTION OF THE PREFERRED EMBODIMENTS

Figure 1:
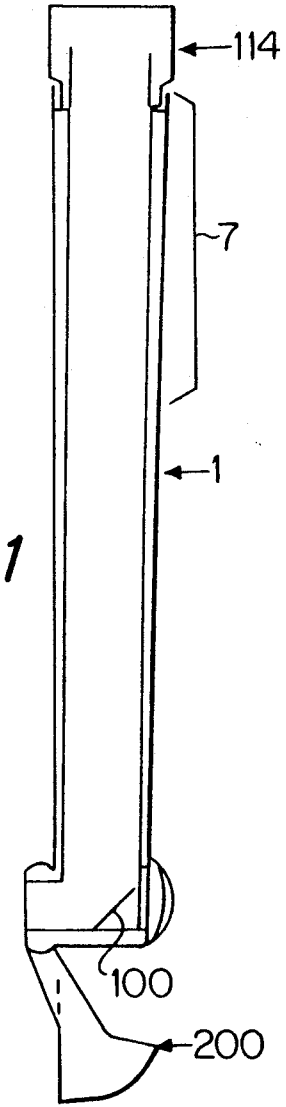
FIG. 1 represents a cross sectional view of one embodiment of the present invention golf club.

Referring to FIG. 1, the present invention golf club can include a hollow shaft 1, a reflecting assembly including at least a mirror 100 placed within the shaft adjacent to a passage 106 in the shaft, club head 200 attached to the end of the shaft 1, and a grip 7, located on the upper half of the golf club shaft, with an enlarged cross section as compared to known golf clubs. The shaft of the present invention golf club is hollow so as to allow the image of the area in front of the club to pass through the passage 106 in the shaft and be reflected up through the shaft of the club to be viewed by the golfer, without moving his or her body. FIG. 1 represents the view of the present invention golf club as it would be held by a golfer, looking from behind the golfer.

As seen in FIG. 1, the reflecting assembly includes at least a mirror 100. The mirror preferably includes a flat or concave reflecting surface, to provide an image of the area where the golf ball is to be hit which is full size or enlarged. Alternatively, in place of the mirror any reflecting means such as fiber optic plastic, a prism which would bend the light, reflecting it up into the shaft, or a combination of fiber optics and prisms can be employed. The mirror may be placed at any point within the shaft, as can the passage in the shaft. The mirror in the embodiment shown in FIG. 1 is preferably placed at the base of the golf club at approximately a 45 degree angle as shown in FIG. 1, with the reflecting surface facing toward the left as seen in FIG. 1. Placing the mirror in this position in the club shaft and at this angle provides the optimum conditions for viewing the area where the golf ball is to be hit.

With the mirror in this position, at the base of the club, the view from the mirror will be as close as possible to the path the golf ball will travel, allowing for the most accurate aiming of the golf club. If the mirror were placed at a point further up toward the top of the club, where the grip is located, the mirror might be angled more toward the vertical so as to allow a golfer to more easily see the ground in close proximity to the golf club. The passage and the mirror must be located relative to each other and to the shaft in such a way that the greatest possible portion of the image of the area in front of the club can travel through the club shaft to be viewed by a golfer.

Regardless of where the reflecting means is placed, it is not to be placed in such a position that it would contact the ball. Further, the reflecting means must be placed so as to maintain the desired balance of the club shaft.

The passage 106 formed in the golf club shaft, adjacent to where the mirror is placed is preferably at least about one inch in diameter. Including a passage of this diameter will allow an optimum amount of light to pass up through the club shaft to be viewed by the golfer. The maximum diameter of the passage 106 is dictated primarily by size constraints to avoid causing the shaft becoming too large and thereby unwieldy. Most preferably, the diameter of the passage 106 is about one inch.

With the mirror in the position shown in FIG. 1, the image of the area in front of the golf club will be reflected off of the mirror and up through the shaft, where it may be viewed by the golfer. With the present invention incorporated into a putter, the mirror assists a golfer in viewing both the placement of the pin as well as the contour of the green between the ball and the pin.

Figure 2:
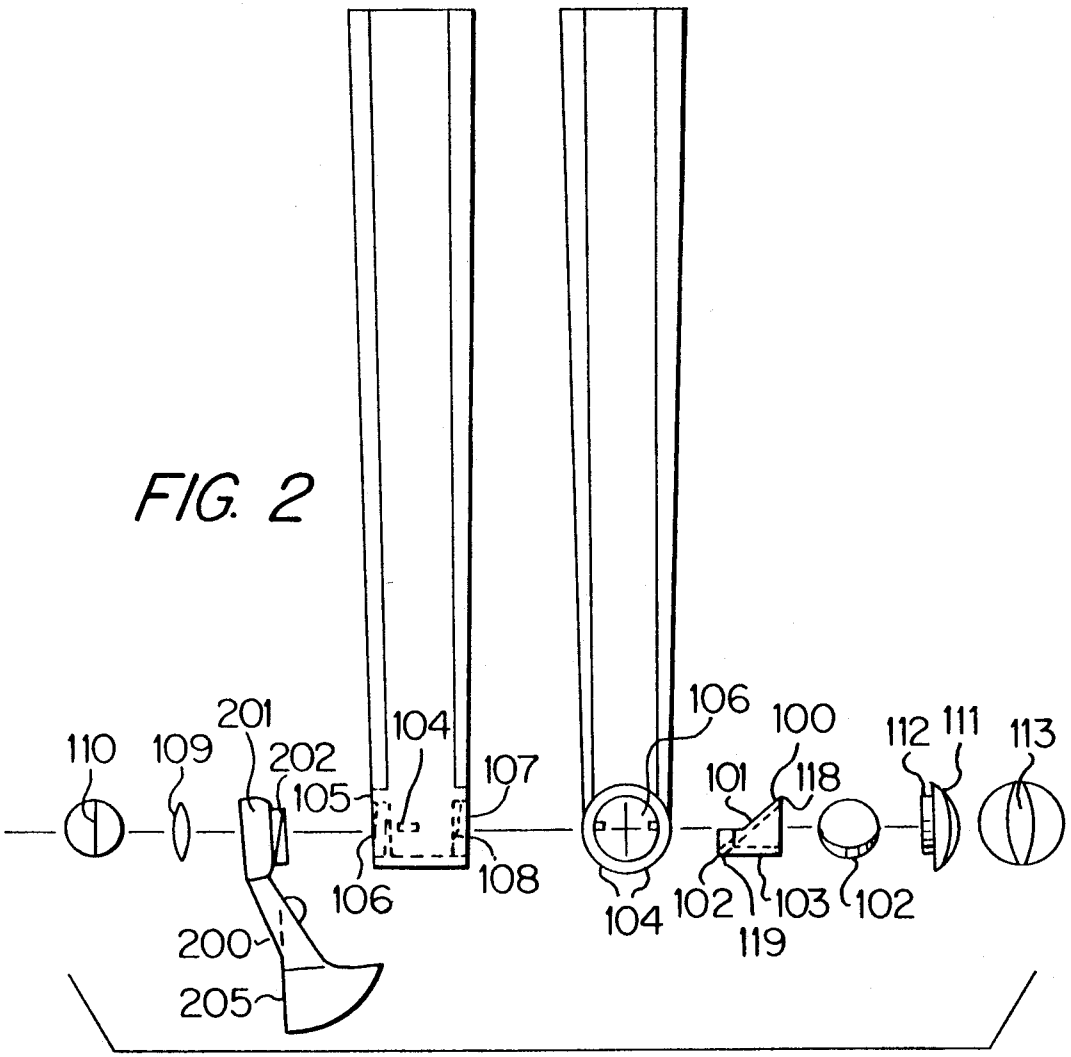
FIG. 2 represents an exploded view of one embodiment of the present invention golf club showing the various parts of the invention.
Figure 8:
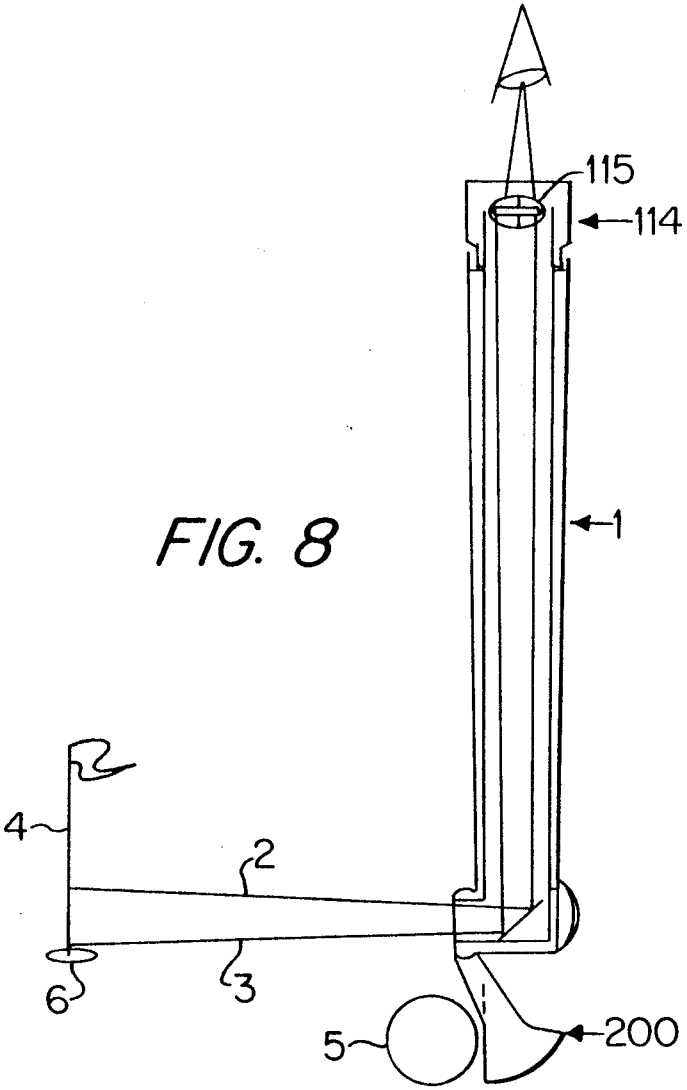
FIG. 8 represents a cross sectional view of a putter incorporating the features of one embodiment of the present invention golf club in relation to a golf ball and pin.

The reflecting assembly as shown in the embodiment shown in exploded view in FIG. 2 can also include a lower reflecting assembly including a lens 109, a mirror 100, a heel cap 111, and elements to mount and/or retain the assembly in a stationary position. The lens 109 may be placed in front of the mirror 100 in a hole 106 formed in the shaft 1. The lens 109 included in the embodiment shown in FIG. 2 is held in place by the club head 200 which is attached to the shaft 1 as described below. The lens can include a sighting line 110 on its face. The sighting line 110, by providing a point of reference, aids the golfer in determining the orientation of the golf club, the area in front of the club and, possibly, the placement of the pin 4 as seen in FIG. 8. In an alternative embodiment, with the club head 200 attached in a different location or with the reflecting means placed at a different location within the shaft, the lens 109 can be held in place by a threaded ring screwed into threaded connection 105 on the hole 106 in the shaft 1. The threaded ring may preferably include a lens.

The lower reflecting assembly, in the embodiment shown in FIG. 2 includes a mirror 100 including at least a lower portion 103 and extensions 102. Although the embodiment shown in FIG. 2 includes a mirror, any reflecting means, such as fiber optic plastic, a prism, or a combination thereof may be included in the reflecting means. The reflective surface of the mirror faces toward the front of the golf club. As seen from the side, the mirror 100 is inclined at a forty-five degree angle from the horizontal, with the rear end 118 which faces away from where the golf ball would be situated of the mirror 100 being higher than the front end 119. If the mirror were placed at a different location along the length of the shaft, the mirror preferably may be placed at an angle greater than 45 degrees from the horizontal. The mirror 100 in the embodiment shown in FIG. 2 is substantially round so as to fit within the passage 106 or 107 formed in the shaft 1. The mirror may be of any shape.

The mirror may be secured within the shaft in a variety of ways. The embodiment shown in FIG. 2 includes extensions 102, a flange 104, and a bottom support 103. Extensions 102 are formed on the lower edge 119 of the mirror 100 as seen in cross section and also from the front in FIG. 2. The extensions 102 preferably contact the extension 201 of the club head 200, which may be threadably inserted into the passage 106 formed into the shaft in the embodiment shown in FIG. 2. The flange 104 formed on the inner surface of the shaft preferably contacts the extensions on the mirror to maintain the mirror in a position so that the image is reflected off the mirror parallel to the club shaft, regardless of how the club head is attached.

The bottom support 103 of the mirror shown in the embodiment in FIG. 2 may be rounded so as to match the contour of the bottom inside surface of the shaft 1. It is this bottom support 103 which may help to maintain to mirror at a desired angle.

To further anchor the mirror in a stationary position, a flange 104 is provided on the inside surface of the shaft 1. The stops are formed on the inside surface of the shaft 1 of the present invention as seen from the front in FIG. 2. By engaging the surface of the mirror 100 after it is placed in the passage 107 in the base of the shaft 1, the placement of the flange helps to prevent the rotation of the mirror relative to the shaft as well as preventing the mirror from moving too far within the shaft to prevent the image of the area in front of the club from travelling up the shaft.

The passage 107 formed toward the rear of the base end of the shaft provides an additional passage through which the mirror 100 assembly may be inserted, adjusted, or serviced. The surface of the passage is lined with a threaded connection 108. A heel cap 111 is also equipped with a threaded connection to allow the reflector assembly to be secured in place in the passage 107.

In the embodiment shown in FIG. 2, the heel cap provides a control over the adjusting of the club head by slightly loosening the cap to allow the golf club head to be rotated as described in greater detail below. By tightening the heel cap, the mirror is forced against the flange and/or the threaded head assembly 202 of the club head. Securing the heel cap in such a manner, the mirror as well as the club head may be immobilized in a desired position. A slot 113 formed on the outer surface of the heel cap provides a means for loosening the cap.

In the embodiment in which the mirror is not located at the base of the club, it would be necessary to include a supporting structure attached to the interior of the club, just below the mirror. Stops could still be placed on the interior sides of the shaft, and a heel cap could secure the mirror from behind and permit its maintenance and adjustment.

Figure 3:
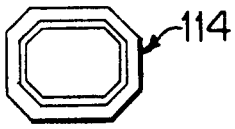
FIG. 3 represents an overhead view of one embodiment of the cap on the shaft of the present invention golf club.
Figure 4:
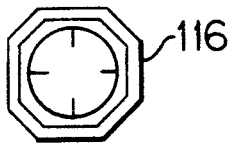
FIG. 4 represents an overhead view of one embodiment of the cap on the shaft of the present invention golf club.
Figure 5:
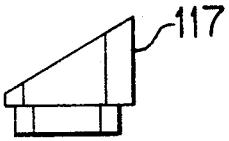
FIG. 5 represents a side view of one embodiment of the cap on the shaft of the present invention golf club.

In addition to the parts of the reflector assembly located near the base of the golf club shaft, the reflector assembly can include additional parts including, as seen in FIGS. 3-5, a cap 114 located at the top of the golf club shaft. FIGS. 3-5 show three possible embodiments of the shaft cap of the present invention golf club. The shaft cap can be mounted on the top of the shaft with any of a number of means, including, among others, threaded and slidable connections.

FIG. 3 shows one possible embodiment of the shaft cap. The cap may be a ring which slides over the end of the club or, alternatively, it may be threadably mounted on the shaft. The cap may be an empty ring, or a piece of flat glass may be placed within the ring to, among other things, prevent matter, such as dirt and debris, from entering the shaft. Alternatively, the shaft cap may include a lens 115 to further magnify the image of the target as shown in the embodiment in FIG. 8.

To further aid the golfer in obtaining the desired alignment of the golf club, the shaft cap can be equipped with markings or extensions 116 which provide a series of reference points. Additionally, the crown can include a prism 117 as seen in the embodiment in FIG. 5. The prism 117 helps to compensate for the natural disposition of a golf club when held by a golfer in which the head 200 of the club is further away from the golfer than the grip. Without the prism 117, the golfer will see the image of the area in front of the golf club at an angle. By employing a prism 117 which includes a top which is angled with the edge of the prism nearest the golfer higher than the edge away from the golfer, the golfer sees the image of the area in front of the golf club from directly above, thereby avoiding any distorting effects which might occur from viewing the image from the side as discussed above.

The shaft in which the reflector assembly is mounted includes, as do all golf clubs, a portion of the golf club shaft, about which the golfer will hold the club, known as the grip. Most golf shafts known in the art are cylindrical and usually of a diameter smaller than about one inch. The problem with these known types of shafts is that although they can include textured surfaces, they are round and do not prevent the shaft of the club from rotating when the golfer strikes the golf ball. If not equipped with some flat portion or an otherwise non-cylindrical cross section, such prior art shafts lack a way for the golfers to know, without looking, if they are gripping the club so that the face of the club is facing in the desired direction, or if the shaft is rotated in their hands. Additionally, known grips are often too thin for the golfer to maintain proper control over the club. The cross section of the grip of the present invention golf club preferably includes a cross section substantially the same as the shaft cap as seen in cross section in FIG. 3.

The present invention solves these problems by preferably providing an oversized grip, the size and dimension standard on grips used on tennis rackets. A grip of this type includes a large cross sectional area and substantially flat sides to allow prevent the grip from twisting in the golfer's hand as a grip with a round cross section would. Additionally, by feeling where the flat surfaces are, the golfer has an idea of where the club head is pointing. In an alternative embodiment, the present invention may include an oval shaped or hexagonal shaft cross section. A variety of non-cylindrical cross sections may be used with the present invention golf club to aid the golfer in resisting the torquing influences of the golf ball hitting the club head.

The club head 200 may also preferably be mounted to the base of the shaft of the present invention golf club. The head is attached, in the embodiment shown in FIG. 2, by a threaded connection 202 on an extension 201 on the head 200. Complimentary threads 105 are formed on the passage 106 leading into the shaft 1 where the lens 109 is placed as described above.

Figure 6:
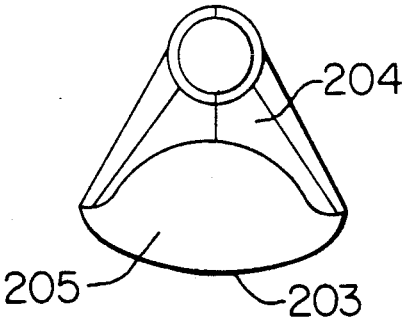
FIG. 6 represents a front view of one embodiment of the head of the present invention golf club.
Figure 7:
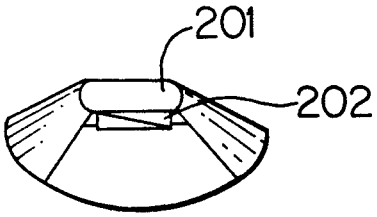
FIG. 7 represents an overhead view of one embodiment of the head of the present invention golf club.
Figure 9:
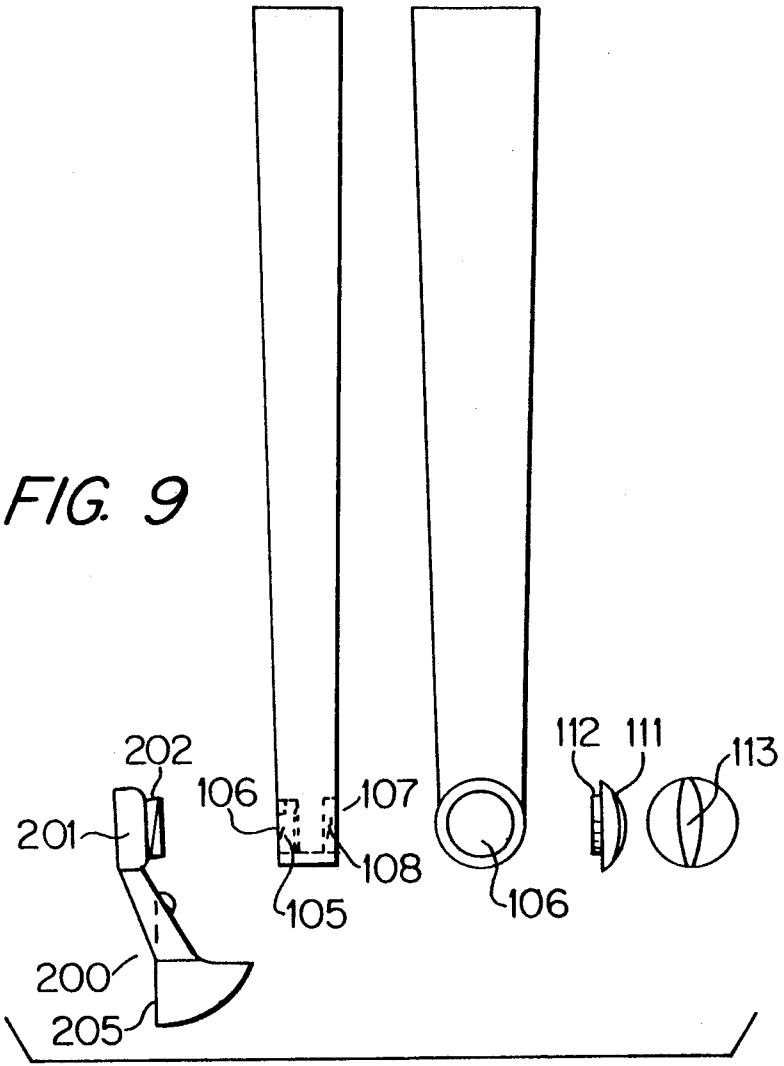
FIG. 9 represents an embodiment of the present invention including the accuracy enhancing improvements to the club head and the improved grip of the present invention.

The head 200 of the present invention golf club may incorporate a number of accuracy enhancing improvements. FIG. 9 shows an embodiment of the present invention including the improved club head but not the reflecting apparatus. Preferred embodiments of the present invention golf club may include either or both the reflecting apparatus and the club head with the accuracy improving enhancements. Some of the club head improvements are shown in FIGS. 6 and 7. The surface 205 of the club head impacts the golf ball as it is hit. The bottom edge 203 of the club head 200 as seen in cross section in FIGS. 1, 2, and 6 is curved. This curvature helps to eliminate the scraping of the club head on the ground as the golfer swings the club.

The preferred method of mounting the club head on the shaft also allows for the rotational adjustment of the head to accommodate golfers of various heights, thereby increasing the chance that the ball will be struck at the optimum spot on the face of the club head. To rotate the head 200 in the embodiment shown in FIG. 2, the heel 113 cap is loosened, the head 200 is rotated into the desired position, and the heel cap 113 is re-tightened. The club may be mounted with alternative means and may be adjusted as described above whether or not the mirror is located at the base of the shaft as seen in FIG. 2.

In an embodiment of the present invention golf club which includes a rotating club head and a reflecting assembly, the mirror and the club head may be integrally attached to the shaft. The mirror may preferably be attached in such a manner that the reflected image remains parallel to the long axis of the shaft regardless of the angle at which the club head is placed. In a golf club of the present invention which lacks a reflecting assembly, the club head still may be rotatably attached in a manner similar to that described above.

The head 200 of the present invention golf club also includes two weighted struts 204 extending from near the point of attachment of the head toward the periphery of the club head. These struts 204 help to eliminate the rotation of the club head resulting from the impact of the ball on the club head. In an alternative embodiment, the struts may project out from the mounting assembly with the rest of the club head attached to the struts. The club head may be seen in cross section in FIG. 2; an overhead view may be seen in FIG. 7.

The operation of the present invention golf club may be seen in FIG. 8. The features of the present invention shown in the embodiment in FIG. 8 are incorporated into a putter. The image of the target, the flag stick 4 and hole 6 in this case, is reflected up through the shaft of the putter as represented by the lines 2 and 3, to the eye of the golfer. The relationship of the club head 200 and the golf ball 5 can also be seen in FIG. 8.

I claim:

1. A golf club comprising:

a hollow shaft having a top end in the vicinity of which a golfer grips the golf club and a bottom end within the vicinity of which a club head is attached;

a reflecting assembly located within said hollow shaft, said reflecting assembly including a reflective surface for reflecting through said hollow shaft an image of a target area where a golfer desires to hit a golf ball, thereby allowing the golfer to view simultaneously the target area while looking at the golf club;

an opening in the vicinity of said top end of said hollow shaft, said opening allowing the golfer to view said reflecting assembly;

said shaft including a first passage formed substantially opposite said reflecting surface, said first passage permitting the image to impact on said reflecting surface and be reflected through said hollow shaft toward said top end of said shaft.

2. The golf club according to claim 1, wherein said reflecting assembly further comprises at least two stops protruding from an inside surface of said shaft which engage at least a part of the reflective surface, and a serrated edge on the lower part of the reflective surface.

3. The golf club according to claim 2, wherein said reflecting assembly further comprises:

a lens placed in front of said reflective surface.

4. The golf club according to claim 3, wherein said lens includes markings on its surface or in its interior.

5. The golf club according to claim 1, wherein a shaft cap including a passage allowing said reflective surface to be viewed is secured on the top of said shaft.

6. The golf club according to claim 5, wherein said shaft cap includes protrusions extending into said passage in said shaft cap.

7. The golf club according to claim 5, wherein said shaft cap includes a prism having an upper face not perpendicular to said the major axis of said shaft, said upper face being properly angled so as to allow either a right or left handed golfer to view said reflective surface while holding said golf club in a position not perpendicular to the ground.

8. The golf club according to claim 5, wherein said shaft cap includes a flat piece of glass placed within the passage.

9. The golf club according to claim 1, wherein a second passage is formed in said shaft substantially opposite the first passage, said second passage including a threaded connection formed on an interior surface thereof and a heel cap including a threaded connection secured in said rear passage, said heel cap threaded connection being complementary to said second passage threaded connection.

10. The golf club according to claim 1, wherein said reflecting assembly further includes a shaft cap lens placed substantially in the vicinity of the top end of said shaft.

11. The golf club according to claim 10, wherein said shaft cap lens includes markings formed on a surface or in its interior.

12. The golf club according to claim 1, wherein said club head comprises:

a ball impacting portion;

an upper extension extending from said ball impacting portion, said upper extension including means for connecting said club head to the first passage in said shaft and a passage permitting said image to pass to said reflective surface;

said connecting means including means for allowing said club head to rotate about said passage in the plane of said passage to permit said club head to be adjusted for golfers of various heights;

said ball impacting portion including a substantially flat ball impacting surface, a lower edge having arcuate cross section taken along both major axes;

a pair of weighted struts extending away from said upper extension toward the periphery of said ball impacting portion.

13. The golf club according to claim 12, wherein said club head is mounted on said shaft with a threaded connection.

14. The golf club according to claim 12, wherein said extension is an inclined substantially inverted V-shape.

15. The golf club according to claim 1, wherein said golf club is a putter.

16. The golf club according to claim 1, wherein said reflective surface is secured substantially at the base of said club.

17. The golf club according to claim 16, wherein said club head and said reflective surface are mounted at the base of the club head.

18. The golf club according to claim 1, wherein said reflective surface is round.

19. The golf club according to claim 1, wherein said golf club includes a grip including an octagonal cross section including:

parallel proximal and distal faces and parallel front and back faces, parallel with the corresponding face of the putter shaft;

said proximal, distal, front and back faces being equal in length and joined by shorter connecting faces.

20. The golf club according to claim 1, wherein said reflective surface is a mirror, prism, or fiber optic prism.

21. The golf club according to claim 1, wherein said reflective surface is flat or concave.

22. The golf club according to claim 1, wherein the shaft has an inner diameter of substantially one inch.

23. The golf club according to claim 1, wherein said reflective surface is substantially at a forty-five degree angle, said reflective surface facing the direction in which said golf ball will be hit.

* * * * *